United States Patent [19]

Ballu

[11] Patent Number: 4,930,531

[45] Date of Patent: Jun. 5, 1990

[54] DEVICE FOR CLEANING THE INSIDE OF A CONTAINER WITH A JET OF LIQUID

[75] Inventor: Patrick J. Ballu, Reims, France

[73] Assignee: Tecnoma, France

[21] Appl. No.: 282,270

[22] Filed: Dec. 9, 1988

[30] Foreign Application Priority Data

Dec. 10, 1987 [FR] France ..... 87 17216

[51] Int. Cl.[5] ..... B08B 9/08

[52] U.S. Cl. ..... 134/167 R; 134/179; 239/227; 239/243

[58] Field of Search ..... 134/167 R, 168 R, 171, 134/172, 179, 180; 239/227, 243, 251, 259

[56] References Cited

U.S. PATENT DOCUMENTS

| | | | |
|---|---|---|---|
| 2,074,052 | 3/1937 | George | 239/227 |
| 2,105,458 | 1/1938 | Johnson | 239/227 |
| 2,947,482 | 8/1960 | Lione | 134/179 X |
| 2,969,188 | 1/1961 | Guigues et al. | 239/243 |
| 3,326,468 | 6/1967 | Bristow et al. | 239/227 |

FOREIGN PATENT DOCUMENTS

| | | | |
|---|---|---|---|
| 534258 | 4/1973 | U.S.S.R. | 134/171 |
| 750784 | 6/1956 | United Kingdom | 239/227 |

*Primary Examiner*—Philip R. Coe

*Attorney, Agent, or Firm*—Watson, Cole, Grindle & Watson

[57] ABSTRACT

The invention relates to a device for cleaning the inside of a container.

A rotor (10) has mounted on it at least one nozzle (12) oriented tangentially so as to cause the rotor to rotate when the said nozzle emits a jet (13) of liquid intended to clean the inside of the container. The rotor (10) is itself mounted on a rotating head (6) capable of rotating about an axis xx' not parallel with the axis yy' of the rotor, this head being provided with an auxiliary spout (7) which causes it to rotate about this axis xx', such that the whole of the inner surface of the container is scavenged. Preferably, the nozzle (12) and the auxiliary spout (7) are supplied with the same cleaning liquid.

7 Claims, 4 Drawing Sheets

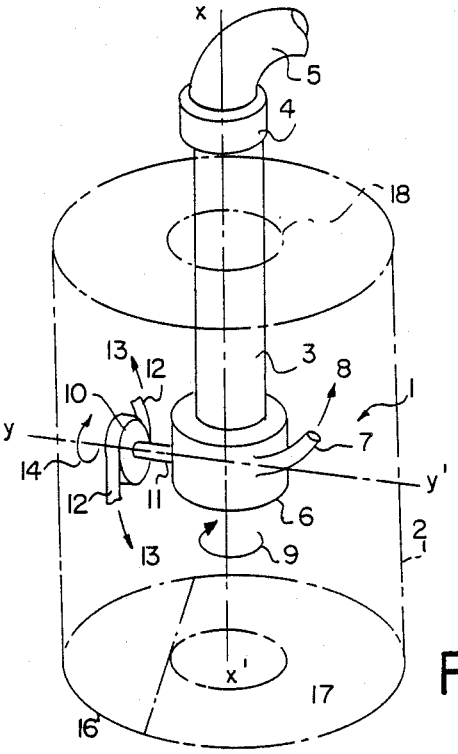
FIG. 1
FIG. 3
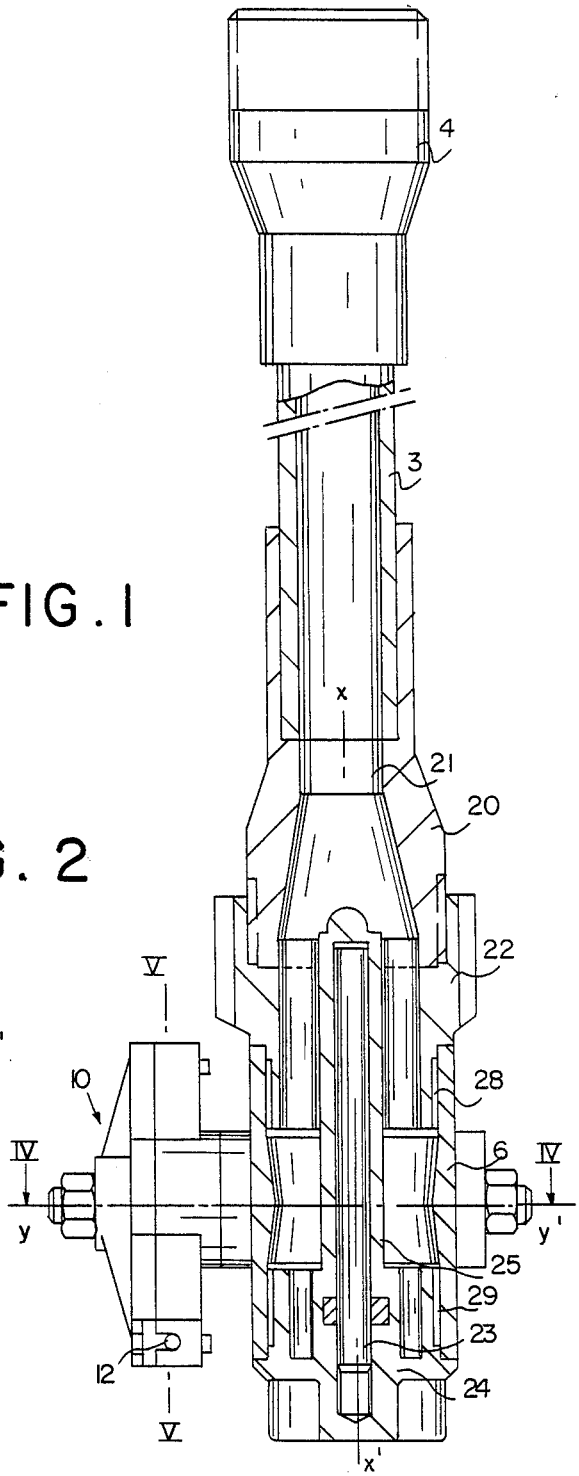
FIG. 2
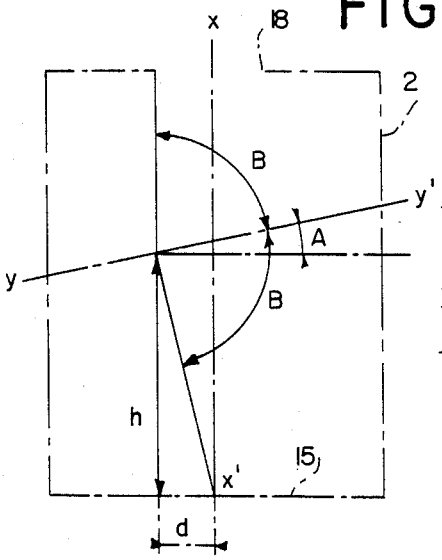

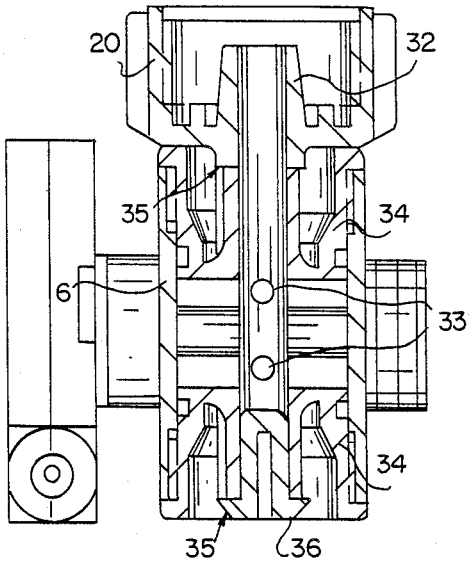
FIG. 6
FIG. 7
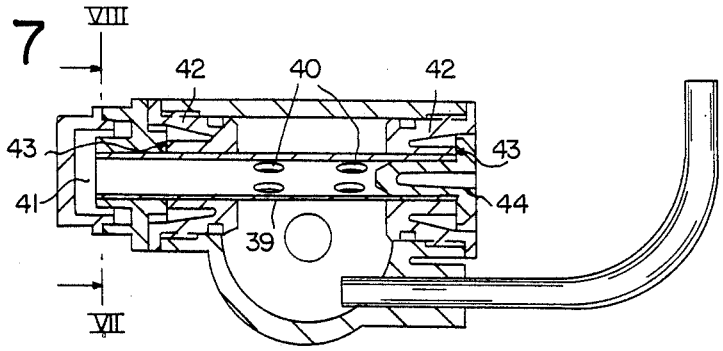
FIG. 8
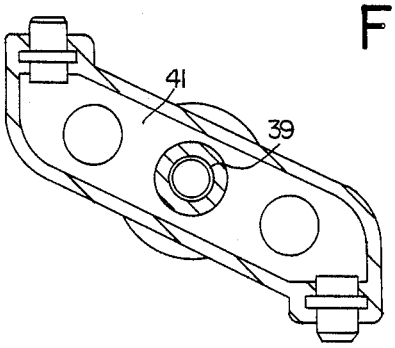

DEVICE FOR CLEANING THE INSIDE OF A CONTAINER WITH A JET OF LIQUID

The present invention relates to a device for cleaning the inside of a container, with the aid of at least one jet of liquid.

In order to clean the inside of a container, it is known to use a nozzle capable of projecting a jet of liquid towards the inner surfaces of this container, it being possible to change the direction of this nozzle so as to enable the jet to reach substantially all the areas on the inner surface of the container. Most frequently, the nozzle is mounted at the end of a flexible pipe, and an operator performs a manual operation in order to direct the jet successively onto all the areas on the inside of the container.

The object of the present invention is to provide an apparatus which enables the entire inner surface of a container to be scavenged, this apparatus being simple to manufacture and inexpensive to maintain.

Consequently, the invention provides a device for projecting a fluid onto the inner surfaces of a container, comprising:

at least one nozzle capable of projecting a jet of the said fluid onto the said inner surfaces of the container, the said nozzle being mounted on a rotor capable of rotating about a first axis yy', the nozzle being oriented so that the jet of fluid is tangential to the said first axis, such that the reaction of the jet causes the rotor to rotate about the said axis;

a hollow rotating head accommodating the said axis yy' and capable of rotating about a second axis xx' which meets the first axis at an angle other than zero, the rotating head being provided with an auxiliary spout oriented so as to produce a jet of fluid tangential to the said second axis, such that the reaction of this jet causes the rotating head to rotate about the said axis;

a hollow support, which may be fixed relative to the container, accommodates the said first axis of the rotating head, the said support being capable of acting as a pipe for supplying the fluid intended for the said spout and the said nozzle;

at least one cylindrical or flat sealing surface provided on the rotor so as to cooperate with a corresponding sealing surface provided on the rotating head, wherein the sealing surface provided on the rotor and/or the corresponding sealing surface provided on the rotating head has a helical or spiral groove, the shape of which is chosen so that, when the rotor rotates owing to the action of the jet of liquid projected by the nozzle, the said groove conveys the liquid towards the inside of the rotating head and forms a dynamic seal.

By "jet tangential to an axis" is meant a jet which is neither parallel to this axis, nor intersects the latter. It is shown that a jet which is neither parallel to nor intersects an axis necessarily has a component which is tangential to a circle perpendicular to this axis and centred about it. It is the part of the reaction force of the jet directed along this tangential component which creates the reaction force driving the rotor or the rotating head in rotation relative to the axis.

Preferably, the auxiliary spout is supplied with liquid via a branched connection from the nozzle supply, the shape and the dimensions of the auxiliary spout and of the nozzle being calculated so that a one-to-one relationship does not exist between the speeds of rotation of the rotor and the rotating head.

Preferably, the said sealing surface of the rotor is conical or flat and directed in the opposite direction to the second axis xx' of rotation of the rotating head and bears against a corresponding sealing surface on the wall of an internal chamber of the rotating head, which chamber is kept at atmospheric pressure, such that the centrifugal force resulting from rotation of the rotating head tends to force the said sealing surfaces against one another, while the pressure of the fluid inside the hollow rotating head acts in the opposite direction.

Advantageously in this case, the said internal chamber of the rotating head is linked to the atmosphere via a passage provided inside the rotor.

According to a preferred embodiment, external surfaces of the rotor, of the rotating head and of the support are parts of the same sphere, such that the assembly has the general shape of a sphere mounted on the end of a cylinder.

The invention will now be described in greater detail with the aid of practical examples of embodiment illustrated with the aid of the drawings in which:

FIG. 1 is a diagrammatic perspective view demonstrating the principle of the device;

FIG. 2 is a theoretical diagram showing how the middle of the bottom of a container can be reached by the jet without the opening orifice being reached;

FIG. 3 is an elevation and partly sectioned view of a device according to the present invention;

FIGS. 6 to 9 are views, similar to FIGS. 3 to 5, relating to variations of the device.

FIG. 1 shows in diagrammatic form a device according to the invention, indicated in its entirety by 1, located inside a container to be cleaned 2, shown in broken lines.

Figure 4:
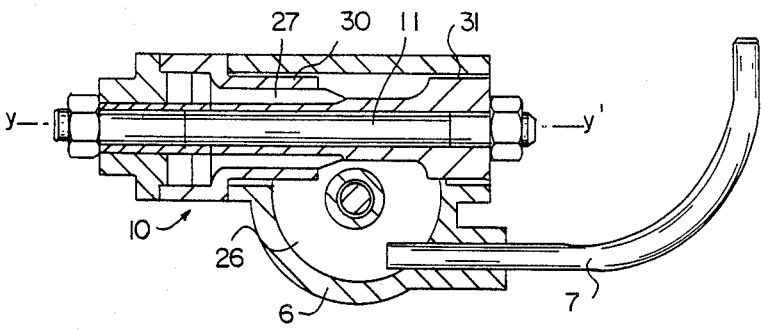
FIG. 4 is a section along the line IV—IV of FIG. 3.

The device 1 comprises a support tube 3 provided at its top end with a seal 4 for joining the said tube to a pipe 5 supplying the pressurized cleaning liquid. At its bottom end, the support tube 3 has a rotating head 6, which is able to rotate about the vertical axis xx' of the support tube 3.

The rotating head 6 is hollow. It has mounted on it a tangential spout 7 located in a horizontal plane. When liquid is conveyed into the head 6, via the support tube 3, the reaction created by the jet 8 emerging from the spout 7 tends to make the head 6 rotate about the axis xx', in the direction indicated by the arrow 9. The head 6 has, in addition, a rotor 10 mounted on a hollow spindle 11 which communicates with the interior of the head 6. The axis yy' of the hollow spindle 11, which is also the axis of rotation of the rotor 10, is horizontal. The rotor 10 is itself hollow and communicates with the interior of the spindle 11. It has two tangential spouts 12 which, when the system is supplied with rinsing liquid, creates tangential jets 13 which drive the rotor in rotation in the direction of the arrow 14.

It can be easily understood that, if the head 6 was stationary, the jets 13 would sweep a vertical plane, the path of which on the bottom 15 of the container is indicated by the straight broken line 16. This straight line is tangential to a horizontal circle 17 which is centred on the axis xx' and the radius of which is equal to the distance of the plane of the rotor 10 from this axis xx'. Rotation of the head 6 causes the plane of the jets 13 to rotate about the axis xx', such that path 16 of this vertical plane rotates about the axis xx' while remaining tangential to the circle 17. This means that the plane of the jets 13 sweeps the entire space around a cylindrical volume which has an axis xx' and the cross section of which corresponds to the circle 17. It will be noted that the surface thus protected is confined and that, moreover, this situation prevents rinsing liquid escaping through the orifice 18 of the container through which the device was introduced inside the latter.

In many cases, the surface 17, which is located opposite the orifice, can be easily cleaned by other means or else is adequately cleaned by the force of the splashes resulting from the impact of the jets 13 on the adjacent bottom area.

However, if this protected surface is not required, it is sufficient, as shown in FIG. 2, to arrange for the axis yy' to be slightly inclined relative to the said surface, instead of being horizontal, so that it forms an angle A with it, while the nozzles 12 form an angle B with this angle [sic] yy' such that $B+A=90°$, and the tangent of the angle (B-A) is equal to the ratio h/d of the height h of the rotor 10 above the bottom 15 of the container to the distance d of this rotor from the axis xx'. In this manner, the volume which is not reached by the jets 13 comprises a cylindrical part with a vertical axis, including the orifice 18 of the container, and a conical part, the apex of which is at the point where the axis xx' passes through the bottom 15 of the container 2.

Other arrangements are, of course, possible depending on the parts of the inside of the container which are to be scavenged or protected.

Figure 5:
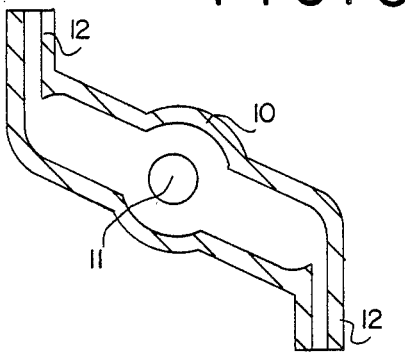
FIG. 5 is a section along the line V—V of FIG. 3.

FIG. 3 shows that the support tube 3 has, at its bottom end, an end-piece 20, onto which a first bearing part 22 is screwed. The latter supports an axial rod 23, the end of which is threaded and onto which a second bearing part 24 is screwed. A part 25, which forms a strut, keeps the parts 22 and 24 at a suitable distance from each other. The rotating head 6 is interposed between the two bearing parts 22 and 24, such that it is able to rotate about the axis xx'. As can be seen more clearly in FIG. 4, the head 6 has mounted on it, on the one hand, a tangential spout 7 consisting of a horizontal curved tube which emerges inside the internal cavity 26 of the head 6, and, on the other hand, the spindle 11 of the rotor 10. The rotor 10 is a hollow part, the shape of which is shown in FIG. 5. It comprises two tangential, diametrically opposite ejection nozzles 12 and its internal volume communicates with that of the head 6 by means of longitudinal and transverse bores 27 in the spindle 11.

In order for the device to operate efficiently, a one-to-one relationship must not exist between the respective speeds of rotation of the head 6 about the axis xx' and the rotor 10 about the axis yy'. If, for example, the two speeds were the same, the impact points of the two jets 13 on the wall of the container 2 would describe a fixed curve, and cleaning would be limited to the immediate vicinity of this curve. Advantageously, the speed of rotation of the rotor 10 is considerably higher than that of the head 6, so as to limit the effects of centrifugal force, which tend to move the jets 13 away from the axis.

The sealing action of the rotating head 6 with respect to the bearing parts 22 and 24, as well as that of the rotor 10 with respect to the rotating head, is ensured at least partly by dynamic seals formed as follows: the rotating head 6 has a cylindrical surface which rotates, with a very small degree of play, inside a coaxial cylindrical surface of the bearing part 22 or 24, and one of these cylindrical surfaces has formed inside it a helical groove 28, 29 which emerges, at one of its ends, inside the internal cavity of the rotating head. One of these grooves has a left-hand thread, the other one a right-hand thread, so that when the rotating head rotates, as a result of the force created by the jet 8, this groove acts in the manner of an Archimedean screw so as to convey the liquid into the cavity. It is obvious that the throughput of the groove is proportional to the speed of rotation and hence the pressure of the liquid itself. Therefore, there is always a very low leakage rate. The rotor itself also has helical grooves 30, 31 which cooperate with cylindrical surfaces of the rotating head, or vice versa, and which operate in the same manner.

FIGS. 6 to 8 relate to variations of embodiment of the support, the rotating head and the rotor, intended to achieve a very small amount of friction when the system is in operation.

The axial rod 23 shown in FIG. 3 is replaced by an axial metal tube 32 which is fitted inside the support 20 and one of the ends of which emerges inside the latter and which has radial bores 33 formed in its central part. Two bearings 34 are screwed inside the rotating head 6 and fitted onto the tube 32, about which they are able to rotate. Two metal washers 35 of suitable thickness are mounted on the tube 32, one between the bearing 34 located at the top, in the figure, and the support 20, the other between the second bearing 34 and a stop 36 which is fixed onto the tube 32 and which closes the latter while ensuring that the rotating head is held in place.

As can be seen in FIG. 7, fixing of the rotor is performed, similarly, with the aid of a tube 39 which has bores 40 in its central part. The tube 39 is fitted inside the rotor 10 and rotates together with the latter, its end emerging inside the internal cavity 41 of the rotor. Two bearings 42 are screwed inside the rotating head 6, these bearings being coaxial and supporting the tube 40, while allowing it to rotate. Metal washers 43 are mounted on the tube 39, one between the rotor 10 and the closest bearing 42, the other between the second bearing 42 and a stop 44 which is fixed onto the tube 40 and which ensures both that this tube is closed and that the rotor is held in place.

Figure 9:
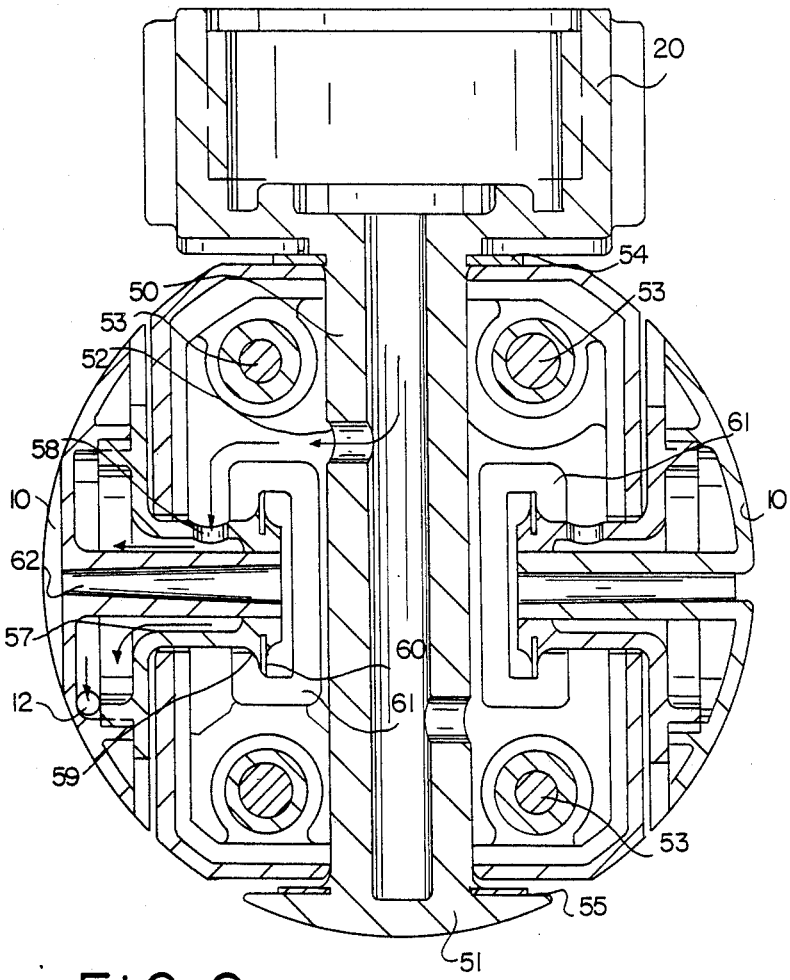

FIG. 9 is a cross section, similar to FIG. 6, of another variation. An axial tube 50 forms an extension of the support 20. It ends in a stop 51, the external surface of which is spherical and has radial bores 52 formed in it. The rotating head 6 consists of two hollow shells in the form of part of a sphere, which are assembled by screws 53. Dynamic sealing bearings 54, 55, consisting of washers provided with spiral grooves, ensure that the rotating head is held in place relative to the tube 50. A lateral spout, not shown, ensures rotation of the rotating head 6. Two symmetrically arranged rotors 10 are rotatably mounted inside the rotating head 6. They comprise a head 56, the external surface of which is in form of part of a sphere and which is provided with spouts 12, only one of which is shown, and a radial hollow rod 57 having formed in it a transverse bore 58 which emerges inside the internal empty space of the rotating head. Ribs 59, supporting dynamic seals 60, hold the rotors 10 in place inside the rotating head, bearing against an internal surface, facing the axis of the rotating head, of a bearing 61 having a cross section in the shape of a C open in the opposite direction to the axis of the rotating head. A pipe 62 passes through each rotor 10 along its axis of symmetry and links the interior of the ring 61 with the atmosphere. Thus, the rotor 10 is held in place inside the ring 61 by the centrifugal force alone resulting from rotation of the rotating head 6 and the rotor 10 relative to the axis of the rotating head.

The external surfaces of the stop 51 of the rotating head 6 and of the rotors 10 together form a sphere which is almost complete and smooth, thereby reducing the risk of damage to the device and the container to be cleaned.

The arrangements described above, which may be used separately, ensure a very small amount of friction and hence maximum efficiency of the jets for a given pressure.

In all of the above, it has been assumed that the axis xx' of the support tube 3 is vertical, the liquid supply seal 4 being above the rotating head 6. This arrangement is suitable for a container of fairly large dimensions, provided with a drainage orifice, not shown, at the bottom. It is, of course, possible to adopt all kinds of different arrangements, and a person skilled in the art will understand, for example, that, in the case of containers without drainage orifices, the container can be positioned with its opening 18 pointing downwards, the entire device thus being used in the reverse position to that of FIG. 1, i.e. from the top downwards.

Other arrangements, for example with the support tube 3 horizontal, are also possible.

We claim:

1. A device for projecting a fluid onto the inner surfaces of a container, comprising:

at least one nozzle capable of projecting a jet of the said fluid onto the said inner surfaces of the container, the said nozzle being mounted on a rotor capable of rotating about a first axis yy', the nozzle being oriented so that the jet of fluid is tangential to the said first axis, such that the reaction of the jet causes the rotor to rotate about the said axis;

a hollow rotating head accommodating the said axis yy' and capable of rotating about a second axis xx' which meets the first axis at an angle other than zero, the rotating head being provided with an auxiliary spout oriented so as to produce a jet of fluid tangential to the said second axis, such that the reaction of this jet causes the rotating head to rotate about the said axis;

a hollow support, which may be fixed relative to the container, accommodates the said first axis of the rotating head, the said support being capable of acting as a pipe for supplying the fluid intended for the said spout and the said nozzle;

at least one sealing surface provided on the rotor so as to cooperate with a corresponding sealing surface provided on the rotating head, wherein the sealing surface provided on the rotor and/or the corresponding sealing surface provided on the rotating head has a helical or spiral groove, the shape of which is chosen so that, when the rotor rotates owing to the action of the jet of liquid projected by the nozzle, the said groove conveys the liquid towards the inside of the rotating head and forms a dynamic seal.

2. The device as claimed in claim 1, in which the said sealing surface of the rotor is conical and directed in the opposite direction to the second axis xx' of rotation of the rotating head and bears against a corresponding sealing surface on the wall of an internal chamber of the rotating head, which chamber is kept at atmospheric pressure, such that the centrifugal force resulting from rotation of the rotating head tends to force the said sealing surfaces against one another, while the pressure of the fluid inside the hollow rotating head acts in the opposite direction.

3. The device as claimed in claim 1, in which external surfaces of the rotor, of the rotating head and of the support are parts of the same sphere, such that the assembly has the general shape of a sphere mounted on the end of a cylinder.

4. The device as claimed in claim 1, wherein said rotor includes a cylindrical sealing surface having helical grooves therein and said rotating head includes a cylindrical sealing surface having helical grooves therein.

5. The device as claimed in claim 1, wherein each sealing surface on the rotor is flat and includes a spiral groove therein, and wherein each corresponding sealing surface on the rotating head is flat.

6. The device as claimed in claim 1, in which said sealing surface of the rotor is flat and directed in the opposite direction to the second axis xx' of rotation of the rotating head and bears against a corresponding sealing surface on the wall of an internal chamber of the rotating head, which chamber is kept at atmospheric pressure, such that the centrifugal force resulting from rotation of the rotating head tends to force said sealing surfaces against one another, while the pressure of the fluid inside the hollow rotating head acts in the opposite direction.

7. The device as claimed in claim 6, in which the said internal chamber of the rotating head is linked to the atmosphere by a passage provided inside the rotor.

* * * * *